United States Patent [19]

Van Petten

[11] 3,997,098

[45] Dec. 14, 1976

[54] HELICALLY SEAMED TUBING AND APPARATUS AND METHOD FOR MAKING SAME

[75] Inventor: Louis B. Van Petten, Union Bridge, Md.

[73] Assignee: Brunswick Corporation, Skokie, Ill.

[22] Filed: Apr. 23, 1975

[21] Appl. No.: 568,771

Related U.S. Application Data

[63] Continuation-in-part of Ser. No. 465,176, April 29, 1974.

[52] U.S. Cl. ..... 228/17.7; 210/457; 219/62; 29/157.3 AH

[51] Int. Cl.[2] ..... B21C 37/083; B21C 37/12

[58] Field of Search ..... 228/17.7, 145; 219/62; 210/457; 29/157.3 AH; 72/49–50, 142

[56] References Cited

UNITED STATES PATENTS

| | | | |
|---|---|---|---|
| 1,294,465 | 2/1919 | Horvath | 219/62 X |
| 2,233,233 | 2/1941 | Williams | 219/62 |
| 3,090,336 | 5/1963 | Gruter | 228/17.7 |
| 3,240,177 | 3/1966 | Habdas | 228/145 X |
| 3,356,226 | 12/1967 | Miller et al. | 210/457 |
| 3,487,537 | 1/1970 | Lombardi | 228/145 |

*Primary Examiner*—Al Lawrence Smith
*Assistant Examiner*—K. J. Ramsey
*Attorney, Agent, or Firm*—John G. Heimovics; David S. Guttman; Sheldon L. Epstein

[57] ABSTRACT

A thin perforate, helically wound welded edge tubing is used as a filter core for a roving wound filter. The slightly roughened external edges of the spirally formed welded joint greatly adds to the ability of securing the fiber roving to the tube and prevents relative slippage therebetween. Also, the invention comprehends an apparatus for, and a method of making the helically seamed tube by first drawing a sheet metal from a supply and raising two lateral edges thereof to form flanges. The material can be guided in a helical path by engaging the inside of the flanges so that the trailing edge abuts the leading edge. The abutted edges are heated so that the flanges themselves provide the filler for a weld on the exterior surface thereof. Drive rollers are provided to move the welded tube from the welding area and to torque the tube to prevent edge separation prior to the cooling of the weld.

10 Claims, 18 Drawing Figures

HELICALLY SEAMED TUBING AND APPARATUS AND METHOD FOR MAKING SAME

CROSS REFERENCE TO CO-PENDING APPLICATION

This application is a continuation-in-part application of co-pending U.S. application Ser. No. 465,176, filed Apr. 29, 1974.

BACKGROUND OF THE INVENTION

1. Field of the invention

The present invention relates generally to the continuous formation of tubes and more specifically to the continuous formation of helically welded pipes or tubes formed from strip material.

2. Description of the prior art

Helically wound pipes may generally be classified by their method of formation as interlocking or welded. In the past, heavy gauge materials were welded to form the helically welded pipe. Non-uniformity of the material strips of lighter gauge steel required that they be interlocked to compensate for the non-uniformity of the edges.

The devices of the prior art have included many complicated mechanisms to either interlock the material or to guide the material into a butt weld. Difficulty has been experienced with the butt-welding of thin gauge metal (generally between 0.020 and 0.030 inches thick) since it cannot be guided by the same mechanisms used for the heavier gauge. The number of parts used in the guiding mechanism of the prior art increases the cost and the reliability of the device.

To assure a perfectly mated edge for butt-welding, prior art devices have overlapped the leading and trailing edges of a piece of strip material and cut the edges that are overlapped prior to welding.

Also it has been considered impossible to continuously weld a seam by MIG or TIG welding using material thinner than 0.030 inches and unthinkable when the material is from 0.008 inches to 0.014 inches.

One solution provided by the prior art is to provide an interlocking means for thin gauge material and then so subsequently heat the interlocked edge so as to take advantage of the thick and thin material technology. Though providing a sufficient interlock and welded pipe, this device requires precision operation of a group of sub-assemblies to provide the two mating interlocking seams, as well as an alignment relative to the heating element. Another problem faced by the devices used in welding is to provide sufficient tension on the leading and trailing edge so as to guarantee their mating during the welding operation. Complicated belts and rollers have been used to put a twist on the sheet material so as to increase tension and force the butted edges together on the spiral. These systems, as well as others, again increase the number of necessary parts and decrease the reliability of the apparatus of the prior art.

SUMMARY OF THE INVENTION

This invention comprehends a spirally wound metal filter tube having welded juxtaposed external edges that are slightly roughened due to the welding thereof without the addition of any welding material. This perforated welded metal tubing is used as a core for winding fiber rovings thereover to form filters. One method of forming such a filter and apparatus therefor may be found in U.S. Pat. No. 3,356,226, now owned by the assignee of this invention, the Filterite Corporation. More particularly, metals such as stainless steel, low carbon and medium carbon steels and tin plated steels may be used to make perforate filter tube cores ranging in diameter from ⅝ to 3½ inches by using sheet metal materials from 0.005 thick to 0.030 inches thick. It should be noted, however, that it is not possible to make ⅝ inch diameter tubing from the thicker materials; the generally accepted ranges comtemplated for this invention being tubes having a diameter from ⅝ inches to about 1½ inches made from sheet metals with thicknesses ranging from 0.005 to 0.15 inches; from 1¼ to 1¾ inches diameter tubes made from sheet metals having thicknesses ranging from 0.005 to 0.015 inches; from 1¾ inches to approximately 2¼ inches made from sheet metals having thicknesses ranging from 0.008 to 0.020 inches; and, from 2½ to 3½ and greater, made from sheet metals having thicknesses ranging from 0.015 to 0.030 inches. The juxtaposed edges that are welded as they are helically wound together to form the tubing can be provided with slightly roughened edges in order to better hold the fiber roving material applied during the filter formation.

The method and apparatus of the present device reduces the number of parts and provides basically a single guiding element which engages the inside edge of a flange of a trailing edge of a piece of sheet material and guides it around a helical path into abutment with the leading edge of a piece of sheet material which is guided for a short distance by engaging the inside of its flange to a point at which the flanges are heated sufficiently to cause them to be the filler of a weld.

The guiding member, though engaging both interior flange edges, does not contact the edges at a point of welding. Prior to engaging and abutting the flanged edges of the sheet material, a pair of rollers are provided to produce the flanges on the lateral edge of the sheet material as well as corrugate, if desired, and drive the sheet material from a supply into the guiding element. A cutter is provided which, upon sensing a predetermined length of the continuously formed tubing, cuts the tubing on the fly. Positioned on each side of the cutter are two sets of drive rollers which help move the tubing to the cutter from the welding station and from the cutter to a storage area, respectively. The drive rollers are designed to also exert torque on the freshly welded tube to prevent the edges from separating before the weld sets. Control circuitry is provided to interrelate the functions and drive of various elements as just described. The method and apparatus of the preferred embodiment produces a helically welded pipe or tubing having an outside diameter from ⅝ of an inch on up from sheet material between 5–30 thousandths of an inch thick. If the spiral wrap angle is tightened, it is not necessary to have the flanges contact the guide.

OBJECT OF THE INVENTION

It is the object of the present invention to provide a perforated, thin wall, spiral welded tubing which is useful as a filter core material.

It is another object of this invention to provide such a filter tube that has a thickness of from 0.005 inches to 0.015 inches when the tube has a diameter of from 1 to 1½ inches.

It is another object of the present invention to provide a method and apparatus for continuously producing such welded tubing.

Another object is to provide an apparatus and method for forming the continuously helical seamed welded pipe from sheet material from 5–30 thousandths of an inch thick.

A further object of the present invention is the provision of a method and apparatus of high reliability and a minimum number of parts to provide continuously welded helical wound pipe.

Other objects, advantages and novel features of the present invention will become apparent from the following detailed description of the preferred embodiment when considered in conjunction with the accompanying drawings.

DESCRIPTION OF THE PREFERRED EMBODIMENTS

Figure 5:
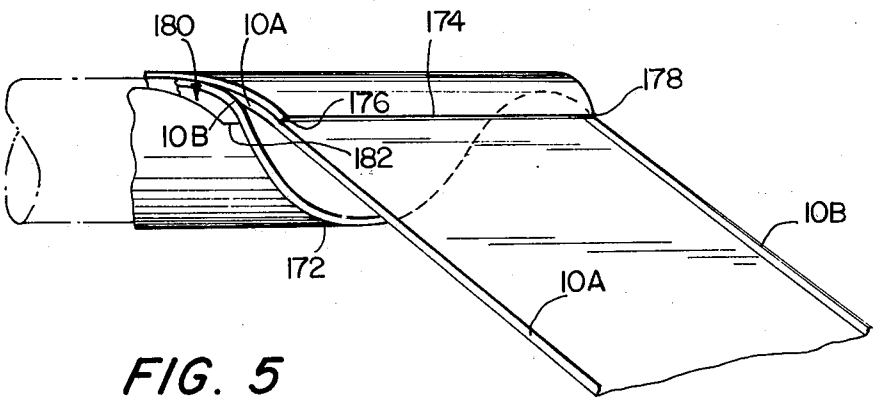
FIG. 5 is an enlarged partial view of the guide liner and sheet material.
Figure 5A:
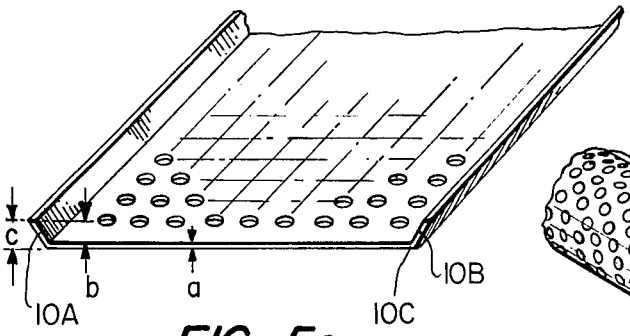
FIG. 5*a* is an enlarged perspective view of a section of the sheet material with side flanges.
Figure 5B:
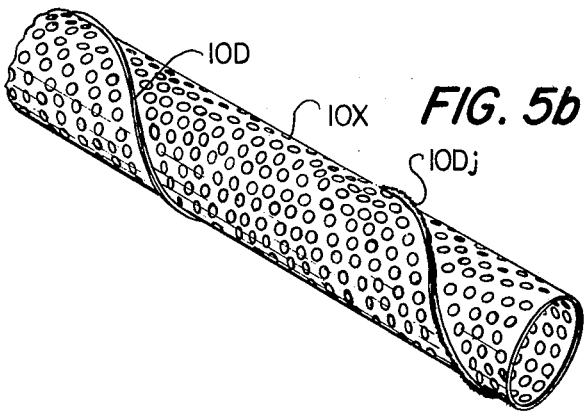
FIG. 5*b* is perspective view of a segment of the welded tube 2.

The helically welded tubing 10X is depicted in FIG. 5*b* and illustrates a preferred embodiment of the subject invention. The illustrated tubing 10X is formed by the apparatus which is depicted in FIG. 1.

Figure 1:
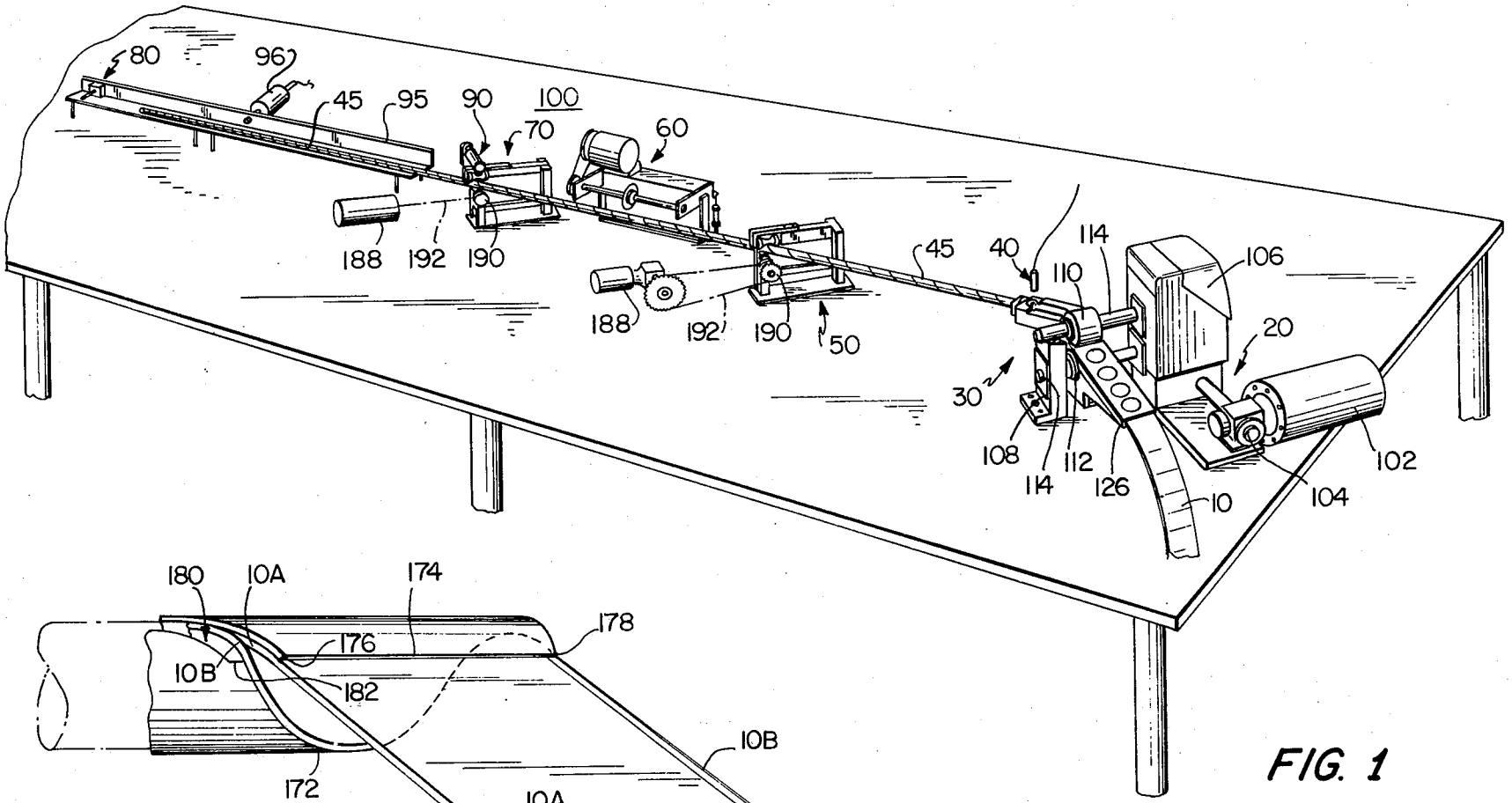
FIG. 1 is perspective view of the apparatus of the present invention.

FIG. 1, which illustrates the preferred embodiment of the apparatus to perform the method of the subject invention, shows a strip of sheet material 10 being drawn from a supply (not shown). The sheet material 10 is drawn from said supply and has flanges formed on the two outer edges of the sheet material at flange forming and drive assembly 20. The flanged sheet material 10 is fed into a guiding and forming box 30 wherein the trailing edge of the sheet material is guided into abutment with the leading edge of the sheet material, at which point it is welded by a welding device 40. The helically welded pipe or tubing 45 exits the forming and guiding box 30 and is torqued and driven by drive roller assembly 50. The torque produced tightens the helix and thus prevents the abutted edges from separating before the weld cools. The drive roller assembly 50 drives the pipe or tubing past a flying cutter 60, which upon a proper electrical command, rotates down and cuts the continuous welded pipe 45 without impending movement of the pipe or tubing. Past cutter 60 is a second drive roller assembly 70 which carries the cut pipe or tubing away from the cutter 60.

Positioned in an appropriate place down the line from cutter 60 is a sensor 80 which senses a predetermined length of tubing 45 so as to activate the cutter 60. As to be explained more fully in later sections, a sensor (for example, an electric eye) is positioned immediately before drive 70 to sense the presence of the welded tubing 45. When the tubing 45 is absent, the sensor 90 provides a control signal to raise the upper roller of drive roller assembly 70 to receive the end of the continuously welded tubing 45. Once sensing extension of the tube past the drive roller, the upper roller of drive roller assembly 70 to be lowered for driving the tubing. This relationship of sensor 90 and drive assembly 70 will be explained more fully in later sections.

The continuously formed and welded tubing 45 extends generally on an L-shaped support 95. After being cut, the tubing 45 is driven by drive roller 70 onto support 95. Once past the drive roller 70, the tubing is pushed off support 95 into an appropriate receptacle (not shown) by an air cylinder 96. It should be noted that the predetermined length sensing device 80 is slidably mounted upon frame 95. The total assembly is supported on a horizontal surface 100, which may be any sort of horizontal surface, for example, a table.

The present apparatus and method easily handles sheet material under twenty thousandths of an inch and can continuously weld helically wound tubing at rates up to approximately 300 inches per minute.

FLANGE FORMING AND DRIVE ASSEMBLY 20

The flange forming and drive assembly is shown as having a drive motor 102 connected through transmission 104 to the roller drive housing 106. Supported in appropriate journalled openings between roller drive housing 106 and support 108 are a pair of rollers 110 and 112 on shafts 114.

Figure 2:
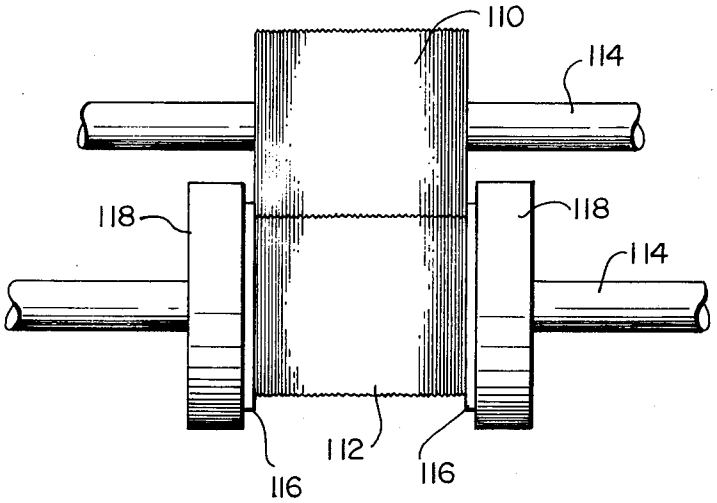
FIG. 2 is a view of the forming drive rollers.

As shown more explicity in FIG. 2, the drive rollers 110 and 112 may have a corrugated surface so as to produce a corrugation in the sheet material 10. It should be noted that these rollers may also be smoothed if corrugation of the sheet material is not desired. The lower roller 112 is machined or has attached thereto shoulders 116 and 118. The shoulders 118 are separated by a distance approximately equal to the width of the sheet material 10 and guides the sheet material between the rollers 110 and 112. The shoulders 116 lie between the roller 112 and shoulders 118 and provides with rollers 112 and the female half of a die, about which the material 10 is bent so as to form the flanges on the lateral edge thereof. As can be seen in FIG. 2, roller 110 is the male half of the die. Thus, as the sheet material 10 is fed into the combination flange forming and drive rollers 110, 112, it is corrugated, if desired, and a flange is formed extending up from the general horizontal surface thereof by the rollers 110 and 112 in combination with shoulders 116. The sheet material 10 is guided in between the rollers by a guiding device 120 shown in detail in FIG. 3. The guiding device 120 has a vertical plate 122 with a recess 124 therein. A horizontal guide frame 126 is generally perpendicular to the vertical support 122 and lies in the plane of the bite between rollers 110 and 112.

Figure 3:
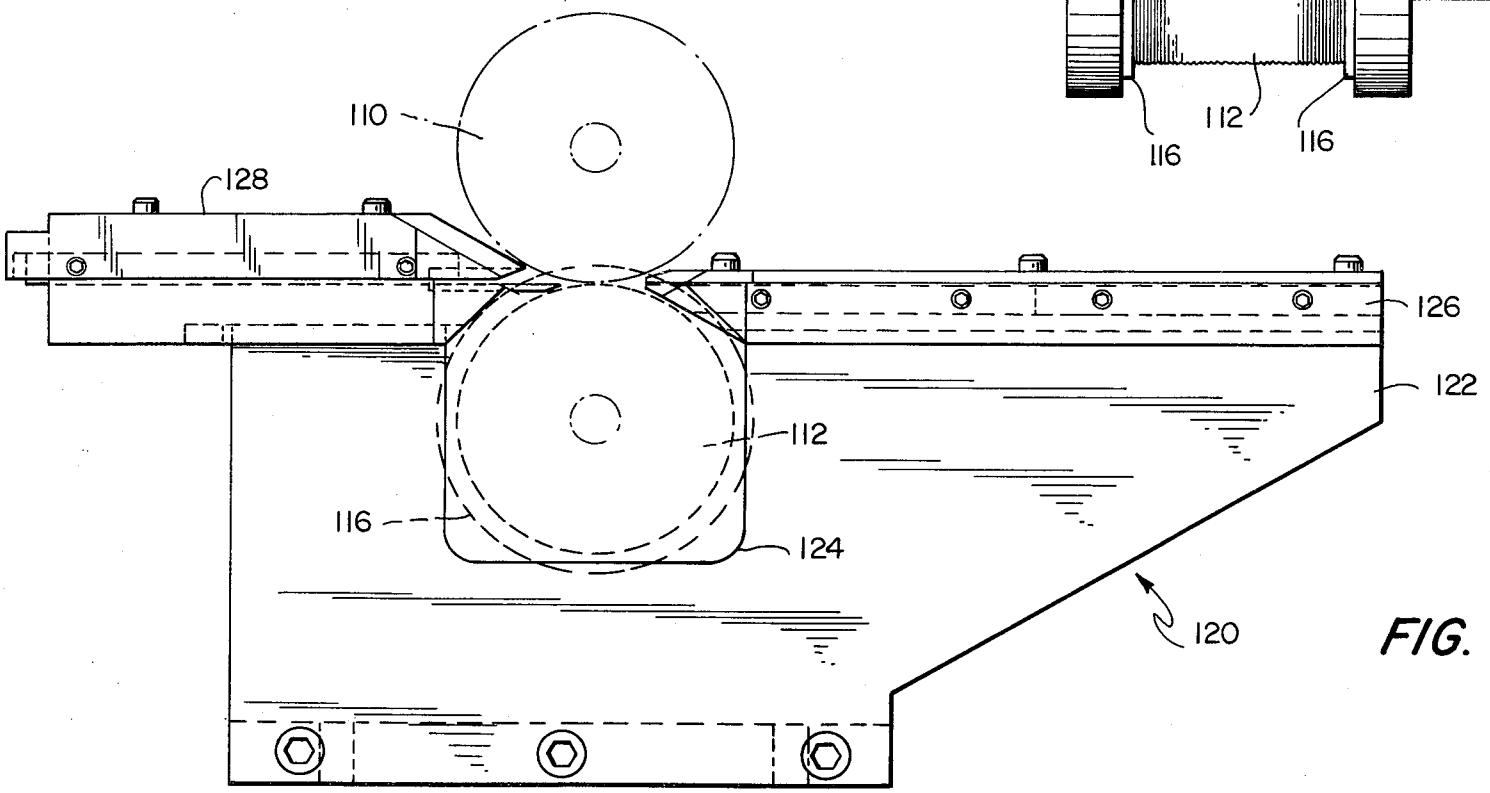
FIG. 3 is a view of the housing for the forming drive rollers.

As shown in phantom in FIG. 3, the roller 112 lies within the recess 124 of vertical plate 122. Whereas the input guide frame 126 is generally horizontal to receive the planar sheet material 10, the output guide frame 128 is shaped so as to accommodate the corrugated horizontal portion and the two flange portions of the reshaped material 10. The output edge of the output guide frame 128 is slanted in the horizontal plane to accomodate the guide and forming box 30 through which the flange forming and drive assembly 20 delivers the flanged sheet material 10 at an angle, (preferably 45°).

GUIDE AND FORMING BOX 30

Figure 4:
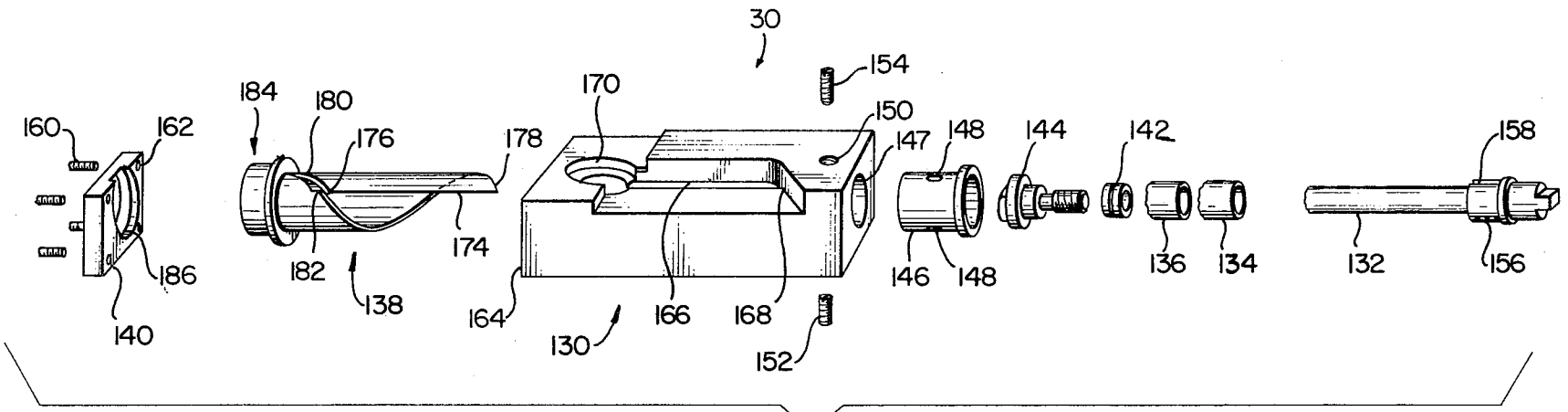
FIG. 4 is an exploded view of the forming guide box assembly.

Explosive view of the guide and forming box 30 is shown in FIG. 4. The guide and forming box 30 has a housing 130 in which are assembled an arbor 132 carrying sleeves 134 and 136. Encompassing the sleeves 134 and 136 is the guide sleeve or liner 138. End cap 140 maintains guide liner 38 stationary and in place within housing 130. A thrust bearing 142 and fastener 144 maintain the sleeves 134 and 136 on arbor 132. An arbor bushing 146 is received within bore 146 of housing 130 and includes apertures 148 in the top and bottom thereof. Housing 130 has apertures 150 in the top and bottom thereof to receive a locking screw 152 and a locking pin 154. The locking screw 152 is received through the aperture 150 in housing 130, aperture 148 in arbor bearing 146 and rests againt a flat surface 156 of the arbor. Similarly, the locking pin 154 is received within apertures 150 of housing 130 and apertures 148 of arbor bearing 146 and aligns with slot 158 of the arbor 132. Thus, once the arbor 132 is inserted through bore 147 of housing 130, it is aligned by locking pin 154 to prevent rotation thereof and is secured from lateral movement by locking screw 152.

Sleeve 134 and 136 may be made of any material, though sleeve 136 is made of a heat resistant material such as copper, since it will underlie the welding station. As will be explained more fully hereafter, sleeves 134 and 136 rotate around arbor 132 as the sheet material 10 is introduced within housing 130. The end cap 140 is secured to the housing 130 by fasteners 160 through apertures 162 in the end cap 140 and 164 in the housing 130, respectively.

The housing 130 has a slot 166 therein through which the sheet material with flanges thereon is introduced. A curved edge 168 of the housing 130 acts as a guide and is generally at an angle to the longitudinal axis of the bore 147 of the housing 130. A generally circular opening 170 is provided in housing 130 for maximum exposure of the helically wound sheet material 10 so that it may be welded. The opening 170 is shown as being circular and may be of any other shape, as long as it provides sufficient space to expose the seam of the sheet material so that it may be welded.

The guide liner 138 is generally a cylindrical member having a forward edge 172 cut so as to form a helical path. The longitudinal edge 174 is formed, thereby and has a length such that edges 176 and 178 engage the inside of a leading and trailing edges' flanges of sheet material 10, respectively. A channel 180 continues around the periphery of the liner 138 beginning at edge 176 of longitudinal edge 174 and being offset from the termination point 182 of helical edge 172.

As can be seen in FIG. 5, the trailing flange 10B follows the helical edge 172 and enters channel 180 leaving edge 172 at point 182. The leading edge 10A is momentarily engaged by edge 176 of longitudinal edge 174 and extends into channel 180. The relationship of points 182 and 176 are such that leading edge 10A and 10B are guided into an abutting engagement in channel 180 in approximately the center away from the walls thereof. It is in channel 180 that the flanged ends 10A and 10B are heated sufficiently to cause them to melt and to become the filler of the welded helical seam of the tubing. Thus, as can be seen from FIGS. 4 and 5, a simple guide liner 138 has been provided which engages the interior side of flanges 10A and 10B and guides these flanges into abutting engagement where they are welded together without the use of a multitude of mechanical subassemblies.

The liner 138 terminates in a shoulder 184 which is secured between the end cap 140 and the housing 130 and received in an aperture 186 of end cap 140. It should be noted that liner 138 is rotated about the axis of the housing 130 until points 182 and 176 are properly aligned relative to the feed of the sheet material 10 to produce the desired abutment in channel 180. Once this adjustment has been made, the end cap 140 is secured in place to lock the guide sleeve 138 relative to the housing 130 and the arbor 132.

The forming box 30 and the liner 138 must be made so that the entering strip maintains an angle of $45° \pm 2°$ to the centerline of the forming box and arbor 132. An angle of less than 45° results in a longer welded seam in relation to the length of finished tubing than is required. One virtue of this invention is its simplicity and lack of complicated parts or adjustment. A forming box, liner and drive rolls must be provided for each different size of tubing made. With the 45° angle held constant, a change in the diameter necessitates a change in the width of the strip. The proper width is ascertained by trigonometrical calculation well known to prior art, —diameter desired, X $\pi\times$ sine of angle = width of strip required. This will be the width of drive roller 110. The material must be wider to allow for the flanges turned up on each side. For optimum welding these flanges must be at least 3 times the thickness of the metal. Also liner 138 must be made with a helix angle of 45° and the lead of helical edge 172 and the length of edge 174 must be determined from this.

If the angle M, between the material 10 feed and the centerline of forming box 30 is increased from 45° to approximately 46° to 48° and more preferably from 47° to 47¾°, then natural flexing of the material will assist in holding the edges or flanges 10A and 10B together without using the guide edges 176 and 178.

TUBING DRIVE ROLLER ASSEMBLIES 50 AND 70

Figure 7:
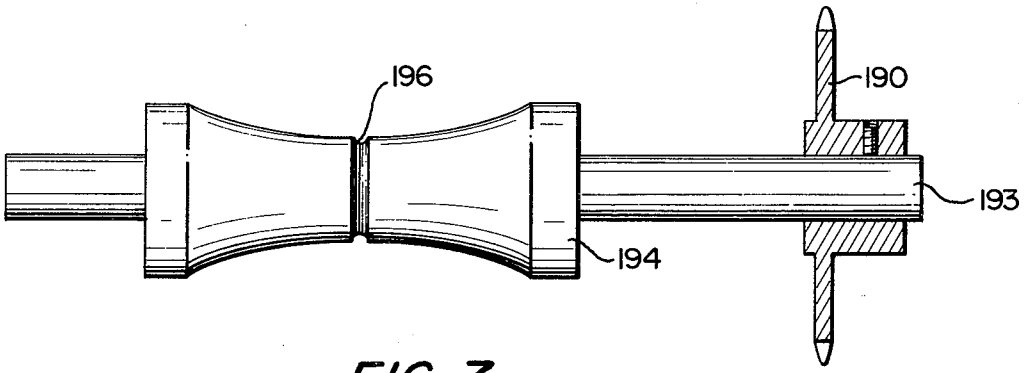
FIG. 7 is a plane view of one of the rollers of FIG. 6.

Tubing drive roller assemblies 50 and 70 as shown in FIG. 1 are driven by motors 188 connected to a sprocket 190 by chain 192. The sprocket 190 is secured to shaft 193 shown in FIG. 7 upon which the lower roller 194 is formed by machining. As may be seen in FIG. 7, the lower roller 194 has a slot 196 in the center thereof to receive the welded seam of the tubing 45 and allow it to pass through the drive rollers. It should be noted that slot 196 may be provided in the top or bottom roller depending upon the orientation of the tubing drive roller assembly relative to the axis of the tubing 45. The top and bottom rollers are machined to have hyperbolic surfaces which produce the required torque on the tubing 45. The shaft 193 is journalled between a pair of brackets 198 which are secured to a base 200. Also secured to the base 200 is vertical support 202 to which are secured horizontal support 204 and 206. The other end of horizontal support 204 is secured to the pair of brackets 198.

Journalled between the horizontal support 206 and a cap 208 is top roller 210. The cap 208 is secured to the horizontal support 206 by bar 212. The drive rollers 194 and 210 have axes which are 90° to each other and receive the tubing 45 at 45° angles relative to their individual axis. This angular relationship and the hyperbolic surfaces provide maximum surfce contact with the tubing 45. The motor 188 keeps the rollers overdriven in spaced and slip on the welded tubing 45 so as to draw the tubing 45 of the forming box and to maintain torque thereon besides merely driving them into the cutter 60. The torque twists the tubing in the direction to tighten the helix. This prevents the edges from separating before the weld set and cools. It should be noted that horizontal support 206 is pinned at 214 to vertical support 202 so that horizontal support 206 and top roller 210 may be raised relative to the bottom roller 194 so as to admit the tubing 45.

Figure 8:
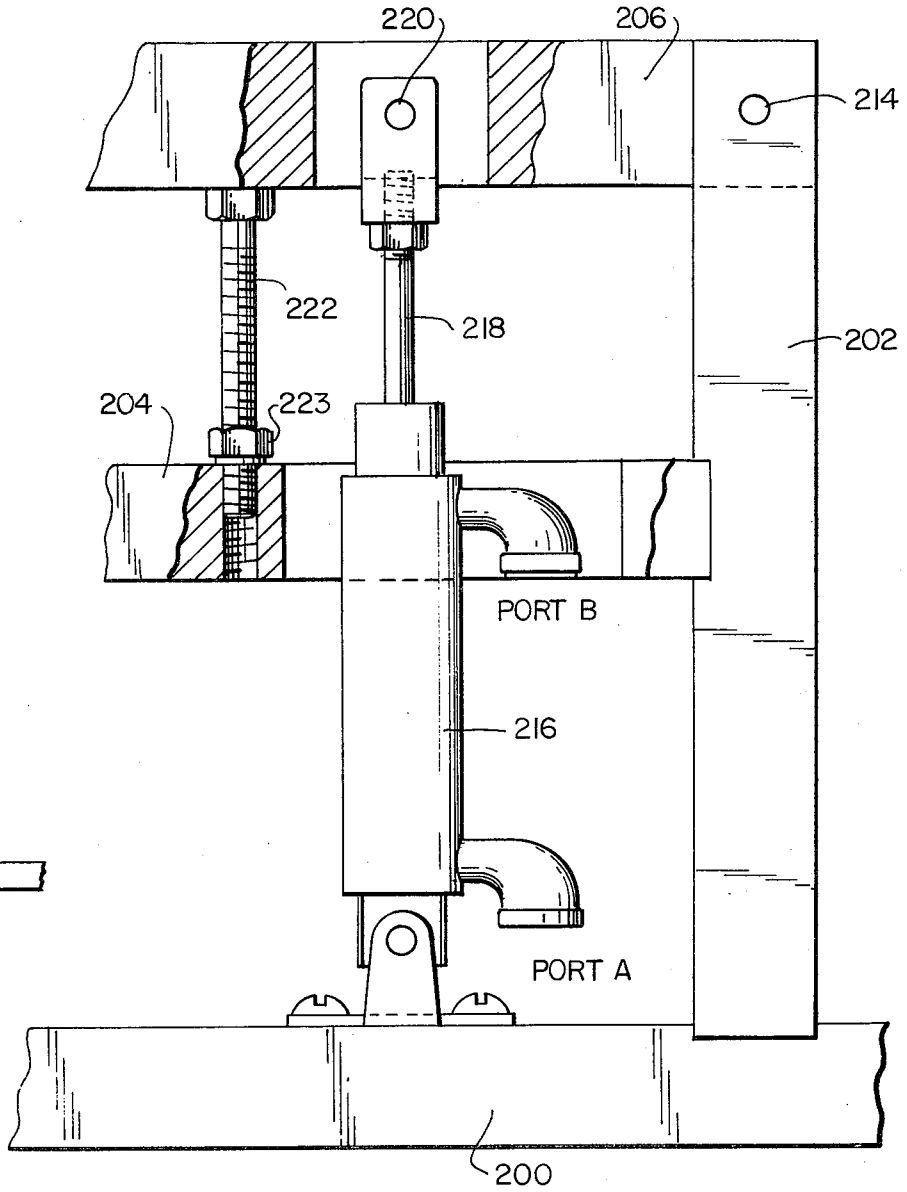
FIG. 8 is a plane view of the control of one of the tubing drive roller assemblies.
Figure 6:
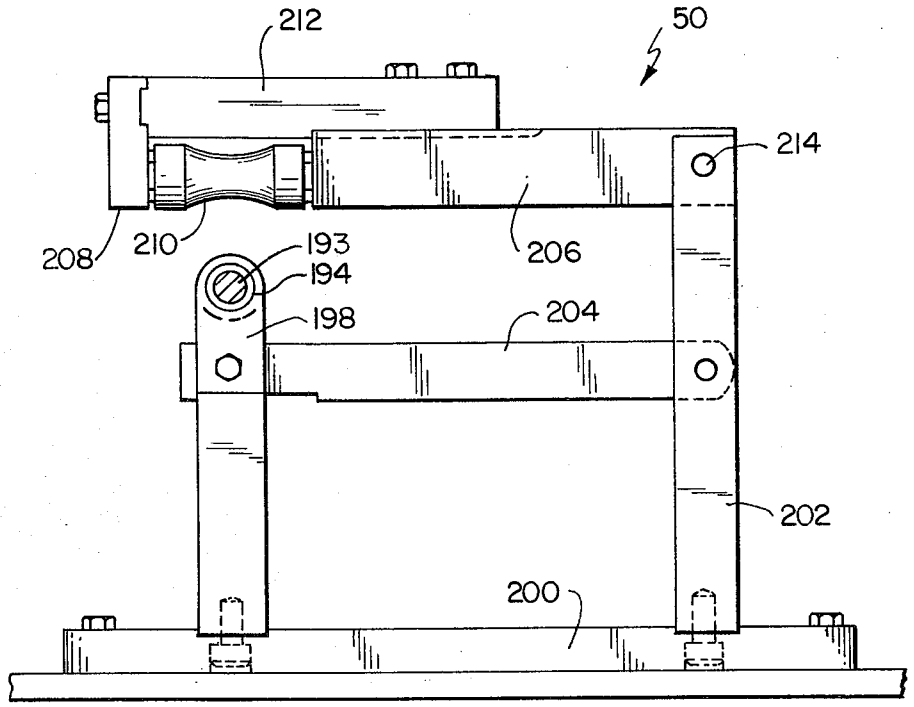
FIG. 6 is a plane view of tubing drive rollers.

As shown in FIG. 8, roller drive assembly 70 is essentially like drive roller assembly 50 having modifications indicated thereafter. Secured to base 200 is a pneumatic cylinder 216 having a rod 218 extending therefrom and pinned at 220 to the upper horizontal support 206. Support 206 is modified so as to receive the end of rod 218 and the pin 220. An opening also is provided in the lower horizontal support 204 to accommodate the cylinder 216 and its rod 218. A stop 222 is secured to horizontal support 204 by a lock 223. As explained briefly in the introduction and the discussion of FIG. 1, when electric eye 90 is not activated by tubing, port A of cylinder 216 FIG. 8 is pressurized thus raising top roller so that space between rollers is greater than tubing diameter and tubing can freely enter. When eye 90 detects tubing it acts through a 3 second (approximately) delay mechanism to exhaust port A and pressurize port B thus lowering arm 206 and holding it against top 222. Stop 222 is set so the space between rollers 194 and 210 is 0.010 to 0.015 less than the tubing diameter, thus giving a firm drive to the tube but not crushing it. When the flying cut off cuts the tubing, the cut section is driven away from the cut off by drive at a faster speed than it is coming to the cut off. As the cut end passes under the electric eye, port B is exhausted and port A is pressurized thus releasing the tubing, at the same time air cylinder 96 (FIG. 1) pushes the tube off the carrier 95 (FIG. 1). As new tubing passes under the electric eye the cycle is repeated.

While drive assembly 50 drew the tubing 45 from the welding station 40 into cutter 60, the drive assembly 70 drives the tubing from cutting station 60 onto the support 95. As explained for drive roller assembly 50, drive roller assembly 70 is overdriven so that when the tubing is cut, the cut portion is accelerated and wisked away from the cutter 60 through the top and bottom rollers 210 and 194 of the drive roller assembly 70. Once the cut edge leaves the driver roller assembly 70 and passes electric eye 90, cylinder 216 is reactivated to lift top roller 210 to receive the cut end of the next section.

FLYING CUTTER 60

Figure 9:
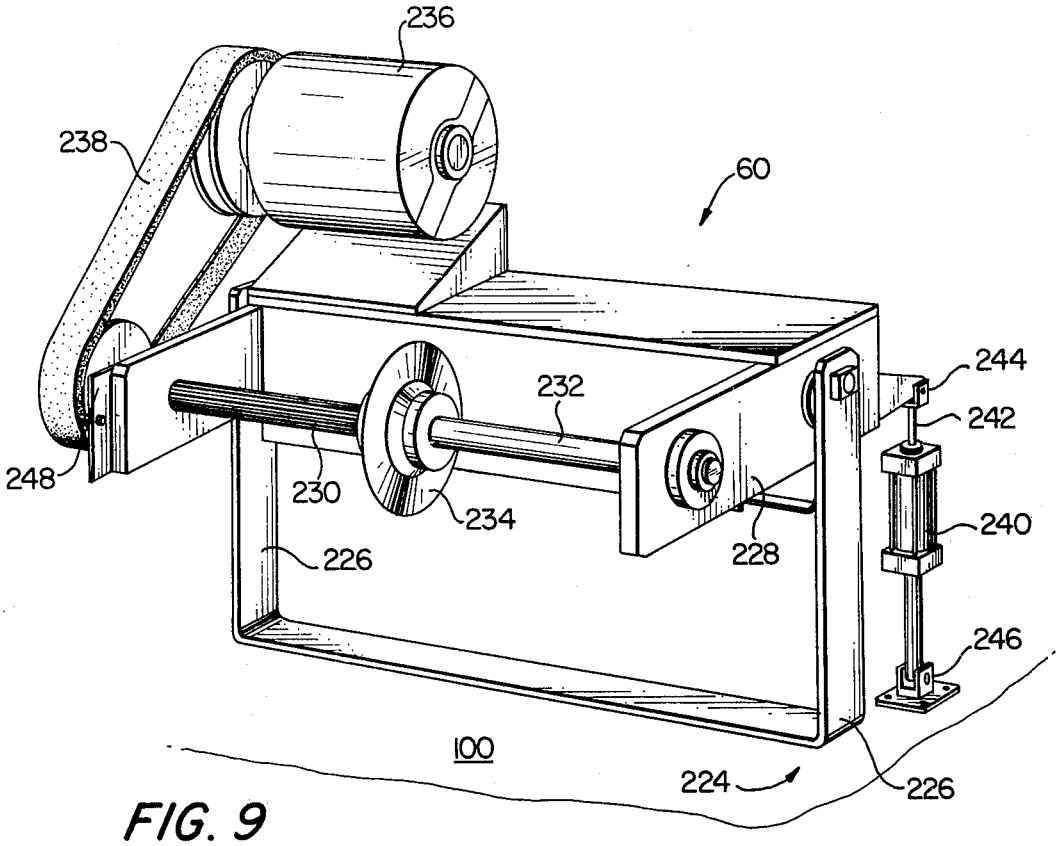
FIG. 9 is a perspective view of the cutter assembly.

The flying cutter 60 is shown in detail in FIG. 9 and has a support bracket 224 with a pair of vertical members 226. Pivotally secured to support members 226 is a pivotal carrier 228. Journalled into the carriage 228 is a fluted shaft 230 having a stop bar 232 thereon. Also on shaft 230 is the circular cutter 234. The shaft 230 is driven by motor 236 connected thereto by a belt 238. At the rear of carriage 228 is a combination air and oil cylinder 240 having a piston rod 242 pinned to the carriage 228 at 244 and secured at the other end thereof of the horizontal support 100 at 246. Cylinder 240 causes the carriage 228 to rotate around the horizontal supports 226 so as to raise and lower the circular cutter 234. The interior of cutter 234 is grooved so as to fit within the fluting on rod 230 so as to be driven thereby. As the cutter 234 engages the tubing 45, it rotates so as to cut through the width and rides along the fluting on rod 230 so as to cut the tubing 45 on the fly and not impede the continuous formation of the helical wound tubing in the forming and guide box 30. Once the circular blade 234 cuts through the tubing 45, the control circuit rotates the carriage 228 by deactivating cylinder 240 out of the plane of the tubing 45 to allow it to proceed further down the line.

To return the blade 234 to the initial position against stop 232, a blast of air is provided by nozzle 248 secured to the carriage 228. The blast of air intersects the blade 234 and sends it back along the fluting 230 to the stop 232. As will be explained more fully hereinafter in the control section, two limit switches are provided in the cutting assembly 60 so as to sense the up and down final position of the carriage 228.

THE TUBING, THE FILTER CORE AND THE FILTER

Figure 5C:
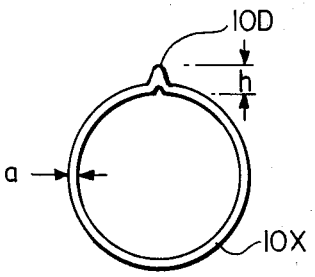
FIG. 5*c* is a section perpendicular to the longitudinal axis to the tube of FIG. 5*b*.
Figure 5D:
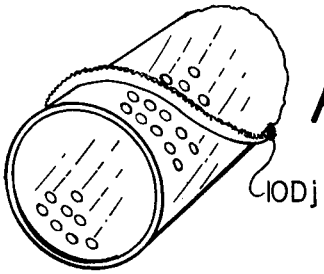
FIG. 5*d* is a perspective view of the tube section of FIG. 5*b*.
Figure 5E:
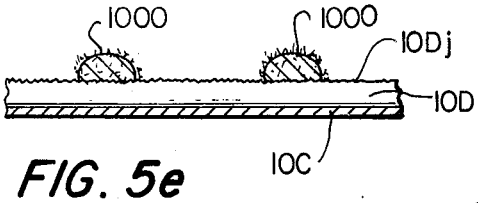
FIG. 5*e* is a perspective longitudinal sectional view of the welded seam.
Figure 5F:
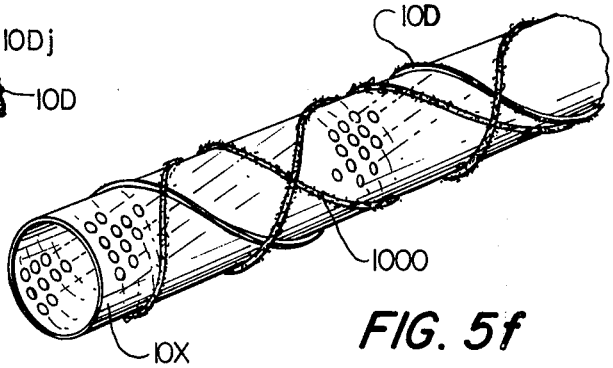
FIG. 5*f* is a perspective view of the welded tube of FIG. 5*d* with several roving overlaps.
Figure 5G:
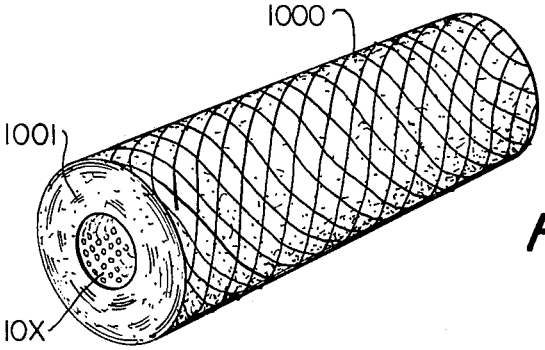
FIG. 5*g* is a perspective view of the filter of this invention.

As indicated previously, an important feature of this invention, as seen in FIG. 5*a*, is that the height of the flange B is at least 3 times the thickness of the sheet 10A's thickness *a*. The overall flange height c obviously must be at least 4 times the thickness *a* as the dimension *c* includes the initial thickness of the sheet. When the tube 10X is formed with the weld 10D, it should be noted that the height of the weld *h* is greater than the thickness *a*. In adjusting the welding head, it has found desirable in some instances to cause a slight bit of irregularity in the weld, thereby making the weld appear as in 10D*j* where it is slightly jagged or serrated. The jaggedness of the weld assists when fiber roving 1000 is wound over the tube when it is cut to length and used as a filter core, as shown in FIGS. 5E and F.

Since no weld material can be added to these thin flanges in order to secure them together, the form of welding used requires heating the edge material to form the welded seam. In order to have a sufficient amount of material available, it has been found that the height of the flange must exceed at least 3 times the thickness of the material of a satisfactory weld cannot be produced. Previous attempts at trying to form spirally wound welded perforate tubes having a size range from ⅝ inch diameter to approximately 3 ⅝ inch diameter have failed when using thin walled material ranging from 5 mils to 30 mils while the invention hereof achieves such a tube. In addition, it has been found, quite surprisingly, that in order to provide perforate tubes having these small diameters it is necessary to go to restore thin walled tubing. It has been found that the following range of tube diameters can be successfully made from the indicated thickness of sheet metal materials:

| TUBE DIAMETER | RANGE OF SHEET METAL THICKNESS |
|---|---|
| ⅝" – 1¼" | .005" – .015" |
| 1¼" – 1¾" | .005" – .015" |
| 1¾" – approx. 2¼" | .008" – .020" |
| 2½" – approx. 3½" (and greater) | .015" – .030" |

In one specific embodiment of the invention, stainless steel and low carbon steel sheets having a thickness of approximately 0.011 inches are formed into tubes having a diameter of approximately 1⅛ inches and rough serrated weld seam having a height *h* of approximately 1/32 to 1/16 inches. This seam corresponds in appearance to the cross section and the serrated edge seam 10D*j* of FIGS. 5*c* and 5*e*.

When the tubing 10X is cut to precise lengths, the tubes 10X can be placed on a machine such as that taught in U.S. Pat. No. 3,356,227, where a diamond fiber roving wind will be applied to the tubing. Quite surprisingly and quite advantageously, it has been found that the raised serrated welded seam 10D and 10D*j* substantially aid the roving 1000 to grip and maintain its position while being wound over the tube 10X. In fact, it has been found that filters which are roving wound over filter cores 10X make superior filters due to the fact there is no relative movement between the body of rovings 1000 and the filter core 10X.

As long as the metal forming the tubing is capable of being welded without the addition of weld material, the tubing may be made of from any metal, including stainless steels, medium carbon steels, tin steel and the like, but not limited thereto. Because the method and apparatus of this invention are capable of producing the thin welded tubing, it has been found quite advantageous to have special tubing made from stainless steels, such as type 304, type 316 and type 347; and, in another specific embodiment of the invention the thickness of the metal ranges between 0.009 and about 0.013 inches and having a diameter of approximately 1 to 1¼ inches. Filter cores of this particular size and diameter when overwrap with roving 100 provide exceptionally good filters and in certain instances the amount of roving may be reduced when compared to a standard filter due to the fact that during the winding operation the fiber roving does not move relative to the core. The roving materials may be made of staple fibers, selected from cotton, glass, nylon, rayon, polyester and other synthetic materials, but not limited thereto.

ELECTRICAL SCHEMATIC

Figure 10:
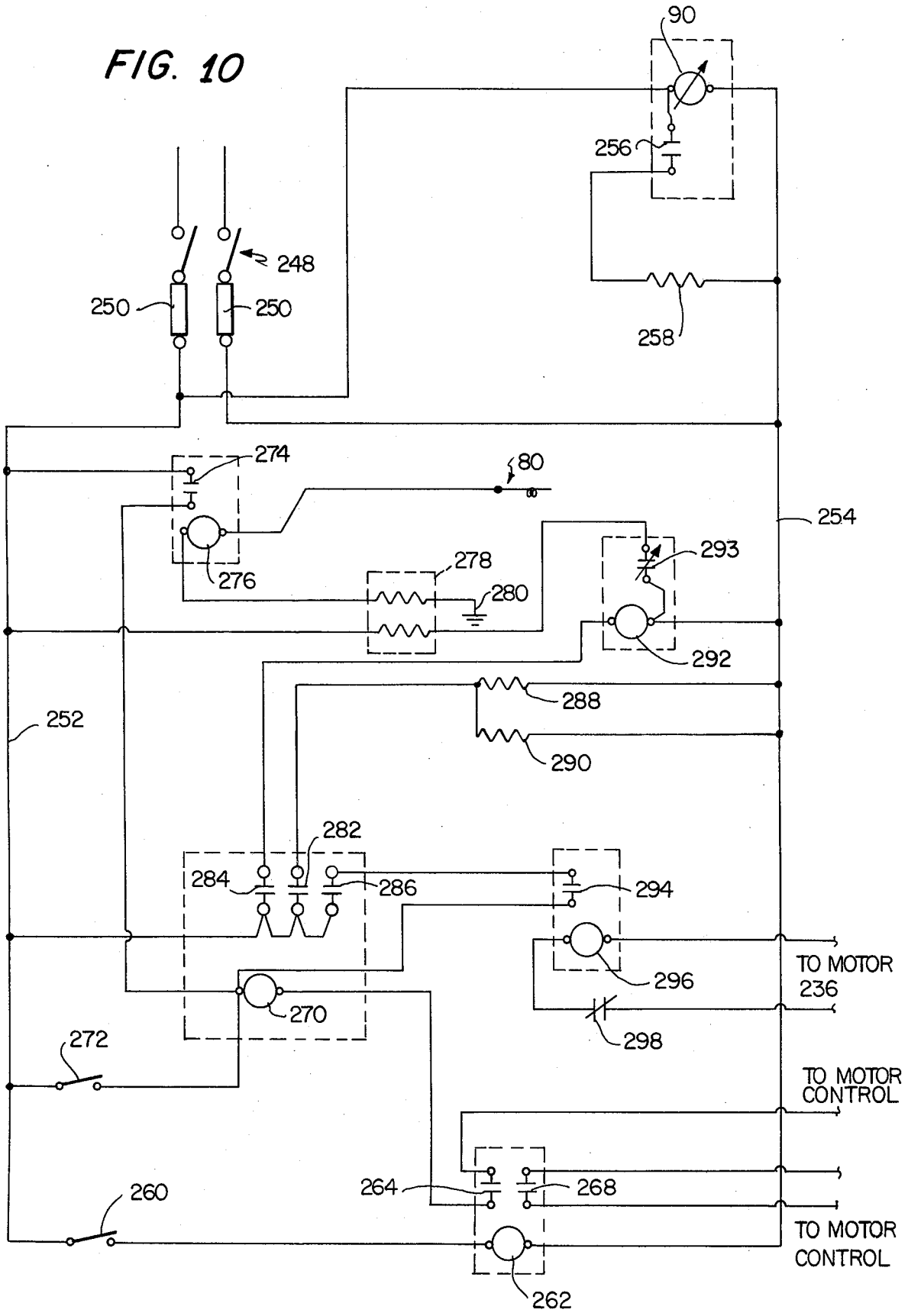
FIG. 10 is an electrical schematic of the control circuit of the present invention; and, FIG. 11 is a pneumatic schematic of the control circuit of the present invention.

The electrical schematic, as shown in FIG. 10, has the AC input power connected across a main power up switch 248 through two fuses 250. Out of fuses 250 are lines 252 and 254, respectively, which complete a general circuit. Connected between lines 252 and 254 is an electric eye 90 located just ahead of drive roll assembly 70 shown in FIG. 1. Upon detecting the presence of tubing 45 the electric eye 90 activates switch 256 thru a short time delay (built in eye mechanism) which completes the circuit to activate solenoid 258 which operates valve $V_3$ to close rollers of drive roller 70 and drive tubing onto and along support 95.

When tubing travels along support 95 to the desired random length for handling, it is touched by finger 80 which is connected to low voltage thru transformer 278, this activates solenoid 276 which closes contacts 274 connecting line 252 to solenoid 270 and on through contacts 264 thru control system thermal relays in motor 236 (not shown) to line 254 thus activating solenoid 270. Motor switch 260 must be closed, activating solenoid 262 thus closing contacts 264 and 268 before this can occur, thus insuring that cut off wheel 234 cannot contact tubing 45 unless motor 236 is running. When solenoid 270 is activated contacts 282, 284 and 286 close. Contact 282 activates solenoid 288 which feed cut off wheel 234 into tubing and solenoid 290 which cuts off air blast holding cut off wheel 234 against its stop, having it free to travel with the tubing 45. Contact 284 activates solenoid 292 which opens contacts 293 and holds them open thru a second time delay, thus preventing any chatter feed back thru contact 80 until after tube 45 has been pushed off of support 95 and can no longer contact finger 80.

Contacts 286 are an interlock thru contacts 294 back to solenoid 270 and hold 270 activated after contacts 274 are open. Contacts 294 are held closed by solenoid 236 which receives its current from motor 236. When cutter 234 lowers enough to cut tubing 45, contacts 298 are opened by a cam thus deactivating solenoid 296. However, contacts 294 are held closed by a time delay mechanism long enough for cutter 234 to travel more than the length of one helix of the tube thus giving a clean cut. As soon as tubing 45 is cut thru, the severed length is driven by drive rollers 70 along support 95 and since tubing 45 is now free, drive rollers 70 no longer slip and tubing 45 is driven at an accelerated rate. When the severed end passes the electric eye 90 it deactivates switch 256 and solenoid 258 which opens the drive rollers, thus releasing tubing 45 and at the same time operating air cylinder 217 which pushes tubing off to support 95 onto storage area.

While this is happening fresh tubing 45 is moving forward from the forming box and as the end of it reaches the electric eye 90, the eye reactivates switch 256 as described before and the entire cycle repeats.

It is important that solenoid 270 must not be activated unless motor 236 and cutter 234 are running. Thus, motor switch 260 operates solenoid 262 which closes contacts 264 and 268 making solenid 270 live and completing the control circuit (not shown) of motor 236. In addition if overloads interrupt the control circuit of motor 236, solenoid 296 will not operate as it draws its current from the motor leads. Switch 272 is a manual switch used to cut a short length or for test purposes.

It is readily seen, and within the scope of this invention that this electrical control circuit can be easily replaced with an air logic system.

THE PNEUMATIC CONTROL CIRCUIT

Figure 11:
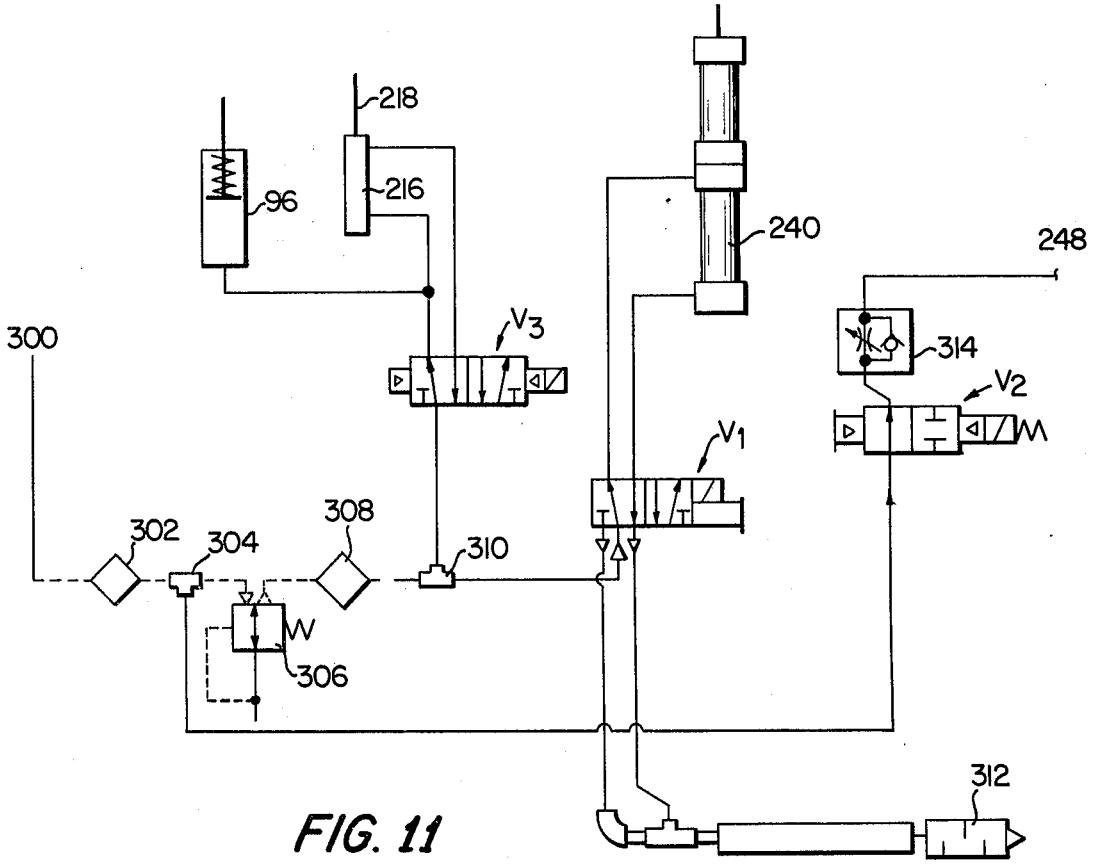

The pneumatic control circuit as depicted in FIG. 11 has an input 300 connected to a filter 302 and a T connection 304. Out of T connection 304 is a regulator 306 into a lubricator 308. Out of lubricator 308 is a T connection 310 having one side connected to a four-way solenoid controlled valve $V_3$. The output of solenoid control valve $V_3$ is connected to pneumatic cylinder 216 of the second tube drive roller assembly 70, and pneumatic cylinder (with spring return) 96 for pushing the cut tubing off of support 95. The other side of T valve 310 is connected to a four-way solenoid control valve $V_1$, which is connected to the lower half of the cylinder 240 which lowers the cutter assembly 60. Also connected to valve $V_1$ is a muffler 312. Connected to the other side of T 304 is a solenoid control valve $V_2$ which controls through needles valve 314 the air blast 248 which blows back the cutting blade to its initial position. The valves $V_1$, $V_2$ and $V_3$ are controlled, respectively, by solenoids 288, 290 and 258 as illustrated in FIG. 10.

OPERATION

The operation of the present invention begins with the material 10 being pulled from a supply and having flanges 10A and 10B formed therein by the flange forming and drive assembly 20. The flanged material 10 is then introduced into a guiding and forming box 30 wherein the trailing edge flange is guided along a helical path to come into abutting engagement with the leading edge flange wherein it is heated sufficiently so that said flanges melt to provide a filler material for the weld. The welded tubing 45 is driven by drive rollers 50 past a cutter assembly 60 which is pivotally controlled so as to rotate down into the axis of the tubing 45 and to cut it on the fly. The tubing is driven past and away from the cutter by drive roller 70 whose drive is controlled by a sensor 90. The cutter 60 is activated by an adjustable feeler 80 which senses a predetermined length of tubing 45.

The present apparatus and method is capable of effectively and efficiently handling sheet material of from 5 to 30 thousandths of an inch to form a tube having an outside diameter from  inch on up. By using a single guide liner, the number of parts required to shape the helically wound tubing is reduced to a minimum. Production of tubing at a rate of 280 inches per minute is possible with the present apparatus.

Although the invention has been described and illustrated in detail, it is to be clearly understood that the same is by way of illustration and example only and is not to be taken by way of limitation, the spirit and scope of this invention being limited only by the terms of the appended claims.

What is claimed:

1. An apparatus forming metal tubing having helical welding seams from sheet material comprising:

means for forming a flange on both lateral edges of said sheet material;

means for guiding a trailing edge flange into abutment with a leading edge flange by engaging the inside of each flange, means for welding said abutted flanges, means for holding said welded edges in abutment until the weld sets, said holding means including A pair of drive rollers having hyperbolic surfaces for exerting a torque on said tubing to tighten the helix, the axes of rotating of said pair of drive rollers beginning perpendicular to each other and 45 degree to the longitudinal axis of the formed tubing, and drive means for overdriving said pair of rollers to product said torque.

2. The apparatus as in claim 1 wherein said guiding means includes a sleeve and a core within said sleeve, said sheet material is received between said sleeve and core and said sleeve engages the inside of said flanges.

3. The apparatus as in claim 2 wherein one end of said sleeve has a helical shape for engaging the inside of said flange of a trailing edge and guiding it into abutment with the leading edges flange.

4. The apparatus of claim 3 wherein said sleeve include a generally helical slot beginning at the termination of the helical end for engaging the inside of the leading edge flange and guiding it into abutment with said trailing edge flange.

5. The apparatus as in claim 4 wherein said slot is shaped such as the leading and trailing edge flanges abut in said slot away from the walls of said slot and are welded in said slot.

6. The apparatus as in claim 2 wherein said guiding means includes means for directing said sheet material between said sleeve and core at substantially at 45° angle with respect to the longitudinal axis of said guiding means.

7. The apparatus as in claim 1 wherein said flange forming means includes a pair of rollers for bending the lateral edge of said sheet material at an angle to the plane of said sheet material.

8. The apparatus as in claim 7 wherein said rollers are shaped so as to corrugate said sheet material.

9. The apparatus as in claim 7 including drive means connected to at least one of said rollers for causing said rollers to drive said sheet material through said guiding means.

10. The apparatus as in claim 1 wherein said welding means heats said abutted flanges sufficiently to form filler for the weld.

* * * * *